US008402948B2

(12) United States Patent
Straub

(10) Patent No.: US 8,402,948 B2
(45) Date of Patent: Mar. 26, 2013

(54) ENGINE ASSEMBLY INCLUDING FUEL SYSTEM WITH FUEL LINE CONNECTOR

(75) Inventor: Robert D. Straub, Lowell, MI (US)

(73) Assignee: GM Global Technology Operations LLC

( * ) Notice: Subject to any disclaimer, the term of this patent is extended or adjusted under 35 U.S.C. 154(b) by 353 days.

(21) Appl. No.: 12/822,419

(22) Filed: Jun. 24, 2010

(65) Prior Publication Data

US 2011/0315122 A1 Dec. 29, 2011

(51) Int. Cl.
*F02M 55/02* (2006.01)
*F02M 55/04* (2006.01)

(52) U.S. Cl. ..... 123/469

(58) Field of Classification Search ..... 123/468, 123/469, 456; 239/88, 600, 533.8; 285/113.11, 285/354, 351, 382, 382.4, 382.5, 386
See application file for complete search history.

(56) References Cited

U.S. PATENT DOCUMENTS

| | | | | |
|---|---|---|---|---|
| 4,881,763 | A * | 11/1989 | Guido et al. | 285/382 |
| 6,070,618 | A * | 6/2000 | Iwabuchi | 138/143 |
| 7,516,735 | B1 * | 4/2009 | Doherty et al. | 123/468 |
| 2009/0020007 | A1 * | 1/2009 | Lin et al. | 92/186 |
| 2012/0038142 | A1 * | 2/2012 | Legrand et al. | 285/14 |

* cited by examiner

*Primary Examiner* — Mahmoud Gimie
(74) *Attorney, Agent, or Firm* — Harness, Dickey & Pierce, P.L.C.

(57) ABSTRACT

A fuel line may include a hollow elongate body having a first end and a second end. A first sealing member located on the first end of the hollow elongate body may have a monolithic construction and include a base region and a sealing region. The base region may have a first material hardness and the sealing region may have a second material hardness, the second material hardness being less than the first material hardness. A first connector may be coupled with the elongate body and the first connector and the first sealing member may be configured to sealingly connect to a fuel injector.

11 Claims, 4 Drawing Sheets

ENGINE ASSEMBLY INCLUDING FUEL SYSTEM WITH FUEL LINE CONNECTOR

FIELD

The present disclosure relates to engine fuel systems, and more specifically to fuel injectors and fuel lines.

BACKGROUND

This section provides background information related to the present disclosure which is not necessarily prior art.

A fuel line may be used to connect a fuel injector with a pressurized fuel supply. The fuel line may be sealingly connected to the fuel injector. For example, a sealing member located on one end of the fuel line may mate with a fuel injector connector. In order to ensure a proper seal between the surfaces of the sealing member and fuel injector, the connector may be secured to the fuel injector connector with a relatively large force. Such a large force may cause deformation of the sealing member and/or the fuel injector.

SUMMARY

This section provides a general summary of the disclosure, and is not a comprehensive disclosure of its full scope or all of its features.

A fuel line may include a hollow elongate body having a first end and a second end. A first sealing member located on the first end of the hollow elongate body may have a monolithic construction and include a base region and a sealing region. The base region may have a first material hardness and the sealing region may have a second material hardness, the second material hardness being less than the first material hardness. A first connector may be coupled with the elongate body and the first connector and the first sealing member may be configured to sealingly connect to a fuel injector.

An engine assembly may include an engine structure defining a cylinder, a fuel injector supported by the engine structure and in communication with the cylinder; and a fuel line sealingly connected to the fuel injector. The fuel line may include a hollow elongate body having a first end and a second end. A first sealing member located on the first end of the hollow elongate body may have a monolithic construction and include a base region and a sealing region. The base region may have a first material hardness and the sealing region may have a second material hardness, the second material hardness being less than the first material hardness. A first connector may be coupled with the elongate body and the first connector and the first sealing member may be configured to sealingly connect to the fuel injector.

A fuel system may include a fuel rail, a fuel injector, and a fuel line sealingly connected to the fuel injector and fuel rail. The fuel line may include a hollow elongate body having a first end and a second end. A first sealing member located on the first end of the hollow elongate body may have a monolithic construction and include a base region and a sealing region. The base region may have a first material hardness and the sealing region may have a second material hardness, the second material hardness being less than the first material hardness. A first connector may be coupled with the elongate body and the first connector and the first sealing member may be configured to sealingly connect to the fuel injector.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Figure 1:
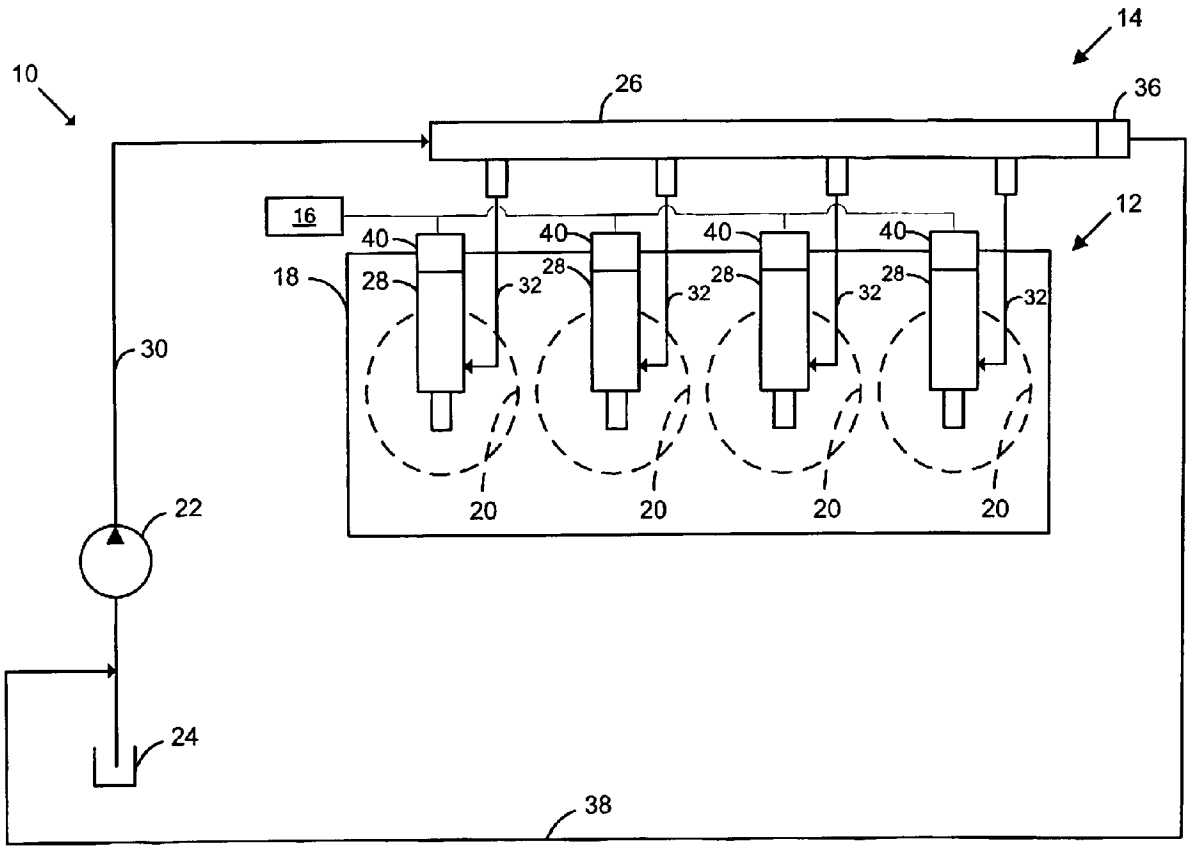
FIG. 1 is a schematic illustration of an engine assembly according to the present disclosure.

Referring to FIG. 1, an exemplary engine assembly 10 is schematically illustrated. The engine assembly 10 may include an engine 12 in communication with a fuel system 14 and a control module 16. In the example shown, the engine 12 may include an engine block 18 that defines a plurality of cylinders 20 in communication with the fuel system 14. While the engine 12 is illustrated as a four cylinder engine in the present disclosure it is understood that the present teachings apply to a variety of engine configurations and is in no way limited to the configuration shown.

The fuel system 14 may include a fuel pump 22, a fuel tank 24, a fuel rail 26, fuel injectors 28, a main fuel supply line 30 and secondary fuel supply lines 32. The fuel pump 22 may be in communication with the fuel tank 24 and may provide a pressurized fuel supply to the fuel rail 26 via the main fuel supply line 30. The fuel rail 26 may provide the pressurized fuel to injectors 28 via the secondary fuel supply lines 32. The fuel rail 26 may include a pressure regulating valve 36 that regulates fuel pressure within the fuel rail 26 by returning excess fuel to the fuel tank 24 via a return line 38.

The fuel injectors 28 may each include an actuation assembly 40 in communication with the control module 16. In the present non-limiting example, the fuel injectors 28 may form direct injection fuel injectors where fuel is injected directly into the cylinders 20.

Figure 2:
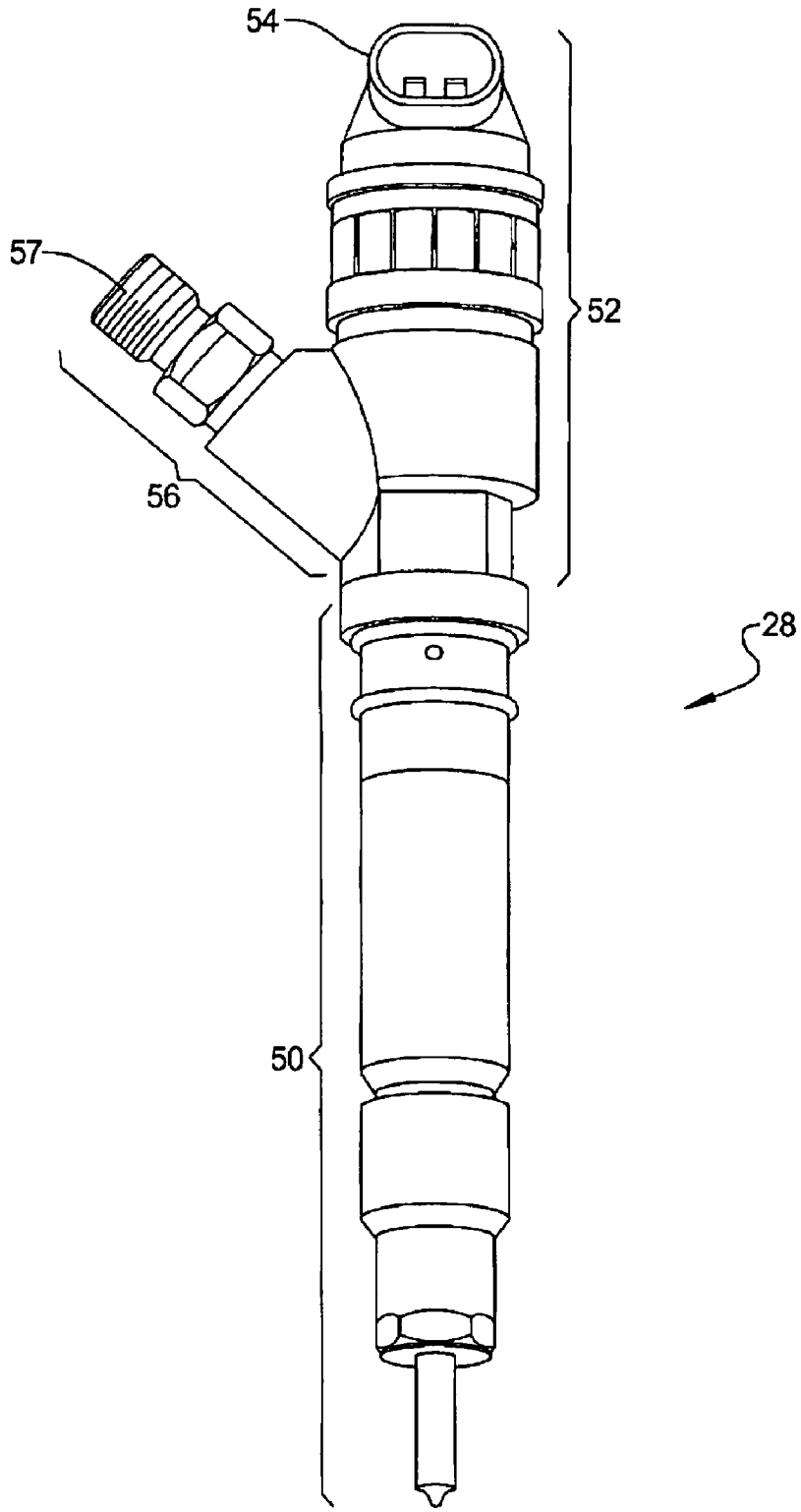
FIG. 2 is a perspective view of a fuel injector of the engine assembly of FIG. 1.

Referring to FIG. 2, an exemplary fuel injector 28 according to the present disclosure is illustrated. The fuel injector 28 may include a first portion 50 and a second portion 52. The first portion 50 of the fuel injector 28 may partially extend within the cylinder 20 such that pressurized fuel may be injected directly into the cylinder. The second portion 52 may extend from the cylinder 20 and be utilized to connect the fuel injector 28 with control module 16 and/or a pressurized fuel source, e.g., fuel rail 26. For example, second portion 52 may include a control module connector 54 that may be operably connected with control module 16 by a wire harness or other electrical connector (not shown). Second portion 52 may further include a fuel inlet connector 56 to connect with the pressurized fuel source. Fuel inlet connector 56 may include a threaded connector 57.

Figure 3:
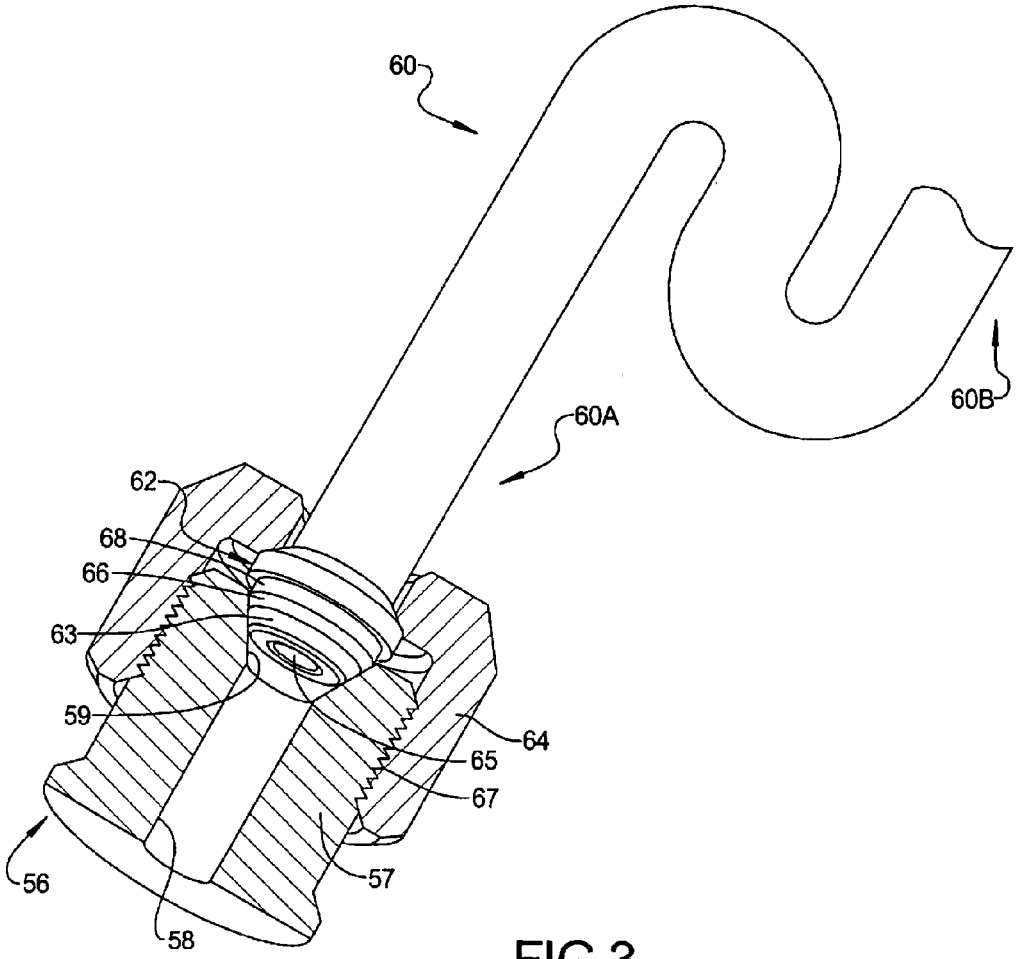
FIG. 3 is a partial section view of a fuel line and a fuel injector of the engine assembly of FIG. 1.
Figure 4:
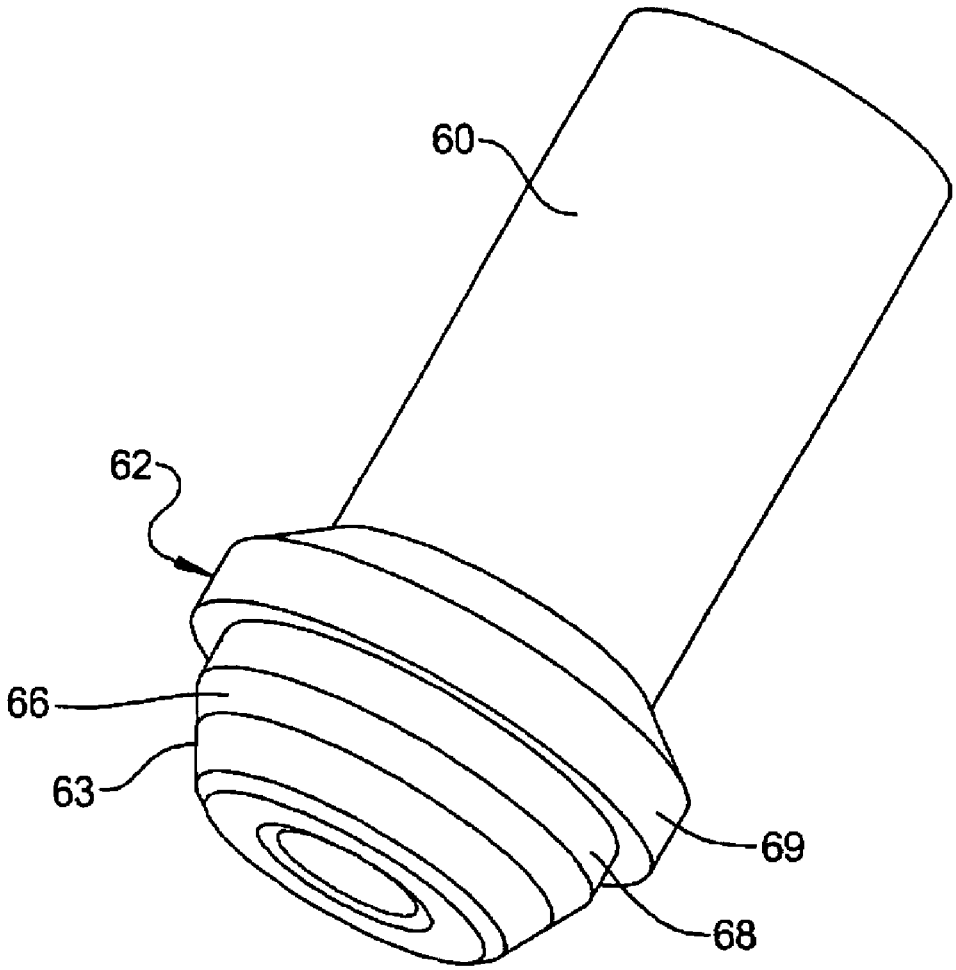
FIG. 4 is a partial section view of a fuel line of the engine assembly of FIG. 1.

FIGS. 3-4 illustrate an exemplary fuel line 60 according to the present disclosure. Fuel line 60 may be utilized as any or all of the main fuel supply line 30 and second fuel supply lines 32. Fuel line 60 may be a hollow elongate body that has a first end 60A and a second end 60B. The first end 60A may be sealingly connected with fuel injector 28, while second end 60B may be sealingly connected with a pressurized fuel source, e.g., fuel rail 26. A sealing member 62 may be located on the first end 60A. The sealing member 62 may, for example, include a semi-spherical member, although other constructions may be utilized. A connector 64 may be coupled with the elongate body. The connector 64 may be utilized to connect with the fuel inlet connector 56 to mate the fuel line 60 with the fuel injector 28. Connector 64 may include threads 67 that engage with the threaded connector 57 in a mated condition (see FIG. 3).

In the mated condition, the threaded connector 57 may engage the connector 64 such that the sealing member 62 is sealingly engaged with the fuel inlet connector 56. For example, an outer perimeter 63 of the sealing member 62 may be brought into contact with an inner perimeter 58 of the fuel inlet connector 56. In a non-limiting example, the inner perimeter 58 may include an interior conical structure 59 that contacts the outer perimeter 63 of the sealing member 62. It should be understood that, alternatively, an inner perimeter of a sealing member may contact an outer perimeter of a fuel inlet connector. A relatively large connection force may be required to ensure a proper seal between the outer perimeter 63 of the sealing member 62 and the inner perimeter 58, and more specifically the interior conical structure 59 of the fuel inlet connector 56. By way of non-limiting example, the connection force may be greater than 8000 Newtons. In this manner, the sealing member 62 may be sealingly engaged with the fuel injector 28 to define a sealed connection from the fuel line 60 to the fuel injector 28.

In some embodiments, a difference in material hardness between the sealing member 62 and the fuel inlet connector 56 may be utilized to ensure a proper seal. For example, the sealing member 62 may be constructed of a material that has a lower material hardness than the material of the fuel inlet connector 56. Upon application of the connection force (such as the force exerted upon the sealing member 62 by connector 64 being threaded upon threaded connector 57), the sealing member 62 may be compressed and the outer perimeter 63 may deform to conform to the inner perimeter 58, and more specifically the interior conical structure 59 of the fuel inlet connector 56, to define a sealed connection from the fuel line 60 to the fuel injector 28.

The sealing member 62 may include a base region 68 and a sealing region 66. The base region 68 may include a ridge 69 that cooperates with the connector 64 to sealingly connect the connector 64 and sealing member 62 with the fuel injector 28. By way of non-limiting example, the sealing region 66 may be fixedly attached to the base region 68 by cladding, plating, welding, adhesives, overmolding or other attachment process. The base region 68 may be constructed of a first material having a first material hardness. The sealing region 66 may be constructed of a second material having a second material hardness. By way of non-limiting example, the first and second materials may include steel, alloyed carbon steel, stainless steel, aluminum, copper or a polymer.

The second material hardness may be less than the first material hardness. By way of non-limiting example, the second material hardness may be at least five percent less than the first material hardness. In this manner, the sealing region 66 may more easily conform (through deformation or otherwise) to the inner perimeter 58/interior conical structure 59 of the fuel inlet connector 56, thus ensuring a proper seal with the fuel injector 28. Furthermore, upon sealing connection with the fuel injector 28, the deformation (if any) of the sealing member 62 may be limited solely or primarily to the sealing region 66. In a non-limiting example, the sealing region 66 may comprise an annular sealing band formed on the outer perimeter 63 of the sealing member 62.

The sealing member 62 may have a monolithic construction where the first and second materials are the same. In a non-limiting example, the first end 60A, second end 60B and sealing member 62 may also have a monolithic construction. In order to create the sealing region 66, the sealing member 62 may be subjected to a process that reduces the material hardness in the sealing region 66. For example only, the sealing member 62 may be annealed in the sealing region 66, such as by laser annealing, induction annealing, etc. Alternatively, the sealing member 62 may be subjected to a process that increases the material hardness of the sealing member 62 outside of the sealing region 66. In this manner, the second material hardness (of the sealing region 66) may be less than the first material hardness (of the base region 68).

What is claimed is:

1. A fuel line comprising:

a hollow elongate body having a first end and a second end;

a sealing member located on the first end of the hollow elongate body, the sealing member including a base region formed from a first material having a first material hardness and a sealing region formed from a second material different from the first material and having a second material hardness less than the first material hardness; and a connector coupled with the elongate body, the connector and the sealing member being configured to sealingly connect to a fuel injector.

2. The fuel line of claim 1, wherein the sealing region of the sealing member comprises a semi-spherical member secured to the base region.

3. The fuel line of claim 2, wherein the sealing member includes a ridge that cooperates with the connector to sealingly connect the connector and sealing member to the fuel injector.

4. The fuel line of claim 1, wherein the connector includes threads that are engaged with a threaded connector of the fuel injector in a mated condition.

5. An engine assembly comprising:

an engine structure defining a cylinder;

a fuel injector supported by the engine structure and in communication with the cylinder; and a fuel line sealingly connected to the fuel injector, the fuel line including:

a hollow elongate body having a first end and a second end;

a sealing member located on the first end of the hollow elongate body, the sealing member including a base region formed from a first material having a first material hardness and a sealing region formed from a second material different than the first material and having a second material hardness less than the first material hardness; and a connector coupled to the elongate body and engaged with the fuel injector, wherein the sealing member is sealingly engaged with the fuel injector to define a sealed connection from the fuel line to the fuel injector.

6. The engine assembly of claim 5, wherein the sealing region comprises a semi-spherical member secured to the base region.

7. The engine assembly of claim 6, wherein the sealing member includes a ridge that cooperates with the connector to sealingly connect the connector and sealing member to the fuel injector.

8. The engine assembly of claim 5, wherein the connector includes threads that are engaged with a threaded connector of the fuel injector in a mated condition.

9. A fuel system comprising:

a fuel rail;

a fuel injector; and a fuel line sealingly connected to the fuel injector and fuel rail, the fuel line including:

a hollow elongate body having a first end and a second end;

a sealing member located on the first end of the hollow elongate body, the sealing member including a base region formed from a first material having a first material hardness and a sealing region formed from a second material different than the first material and having a second material hardness less than the first material hardness; and a connector coupled to the elongate body and engaged with the fuel injector, wherein the sealing member is sealingly engaged with the fuel injector to define a sealed connection from the fuel line to the fuel injector.

10. The fuel system of claim 9, wherein the sealing region of the sealing member comprises a semi-spherical member secured to the base member.

11. The fuel system of claim 10, wherein the sealing member includes a ridge that cooperates with the connector to sealingly connect the connector and sealing member to the fuel injector.

* * * * *